US005865306A

United States Patent [19]

Ovadia

[11] Patent Number: 5,865,306

[45] Date of Patent: Feb. 2, 1999

[54] JEWELRY DISPLAY AND STORAGE APPARATUS

[75] Inventor: Joseph Ovadia, Little Falls, N.J.

[73] Assignee: Ovadia Corporation, Little Falls, N.J.

[21] Appl. No.: 854,062

[22] Filed: May 8, 1997

[51] Int. Cl.[6] ..... A45C 11/04

[52] U.S. Cl. ..... 206/6.1; 206/566; 211/85.2

[58] Field of Search ..... 206/6.1, 562, 564, 206/566, 752, 532, 538, 495; 211/85.2; 220/352, 355

[56] References Cited

U.S. PATENT DOCUMENTS

| | | | |
|---|---|---|---|
| D. 303,764 | 10/1989 | Kilmartin, III . | |
| D. 349,204 | 8/1994 | Lefebvre . | |
| 4,432,300 | 2/1984 | Lyss | 206/538 |
| 4,432,456 | 2/1984 | Ovadia et al. . | |
| 4,948,204 | 8/1990 | Kilmartin, III . | |
| 5,033,625 | 7/1991 | Campbell | 211/85.2 |
| 5,273,153 | 12/1993 | Braun | 206/6.1 |
| 5,323,924 | 6/1994 | Wolff | 206/566 |
| 5,504,294 | 4/1996 | Kilmartin, III . | |
| 5,511,653 | 4/1996 | Ovadia . | |
| 5,540,324 | 7/1996 | Knapp | 206/6.1 |
| 5,649,625 | 7/1997 | Ovadia | 206/6.1 |

*Primary Examiner*—Paul T. Sewell
*Assistant Examiner*—Luan K. Bui
*Attorney, Agent, or Firm*—Sofer & Haroun, LLP.

[57] ABSTRACT

A jewelry display and storage apparatus having top and bottom frame members is provided. The top frame member defines an open gridwork, the gridwork being formed of a series of openings. The bottom frame member is matingly engageable with the top frame member so that when the top frame member and the bottom frame member are matingly engaged, the top and bottom frame members form a peripheral channel about the perimeter of the frames. One or more jewelry mounting pads are provided for mounting within the openings. The jewelry mounting pads are provided with a top surface upon which jewelry may be mounted and displayed, a bottom surface and peripheral side walls. The bottom surface and a portion of the peripheral side walls are securable within a corresponding opening. Spacing means are provided which space top frame member from bottom frame member to facilitate mating engagement and to provide for easy separability of the upper and lower frame members.

10 Claims, 3 Drawing Sheets

JEWELRY DISPLAY AND STORAGE APPARATUS

FIELD OF THE INVENTION

This invention relates generally to a jewelry display and storage apparatus, and more particularly, to a storage and display device having top and bottom frame members that when engaged define a slotted channel about the interior perimeter of the frame openings for receiving and securing one or more jewelry mounting pads within the slotted channel.

BACKGROUND OF THE INVENTION

Jewelry articles such as earrings, pendants and chains can be stored and displayed in a variety of storage devices such as trays, holders or racks. The common type of storage device is a cushioned pad through which the earrings and or pendant posts can be inserted and through which mounting pins can be placed to hold a chain. Other storage and display devices that are in use today are platforms fabricated from wood and covered with cardboard and cushioned vinyl or felt. These platforms are provided with a plurality of tab extensions for retaining the jewelry items. These tab extensions are individually fastened by hand to the cardboard support by a thin wire which is twisted in place. As well, an ornamental band is typically provided about the perimeter of the platform in order to present an aesthetically pleasing display.

Other jewelry display and storage trays are provided with a plurality of openings for receiving jewelry holders. These holders are provided with pads which are normally provided with a peripheral pull tab, and are mounted in a framework or box divided into a series of closed bottom chambers. The peripheral pull tab allows the pad to be removed from the framework for closer inspection by the vendor or potential purchaser.

In order to effect a degree of storage economy, such a framework is often designed to stack upon a similar frame. This is often done by the use of spacer elements or a peripheral downward extending lip. Because the pads are of substantial thickness and are placed in a closed bottomed framework, however, the spacer elements must be of a size that prevents contact between the displayed jewelry and the bottom of the next stacked frame.

This requirement for additional height limits the number of tray frames which may be stacked in a given volume. Further, the use of the peripheral pull tab on the jewelry mounting pad often makes it difficult to remove the pad from the framework as often as insufficient amount of the tab projects upwardly above the frame. Further, the use of such tabs produces a somewhat untidy appearance. Still further the individual pads normally sit within the tray without any means for insuring that they remain affixed therein.

With reference to the aforementioned wood platforms, these platforms do not have the stackability feature as described herein.

As set forth in U.S. Pat. No. 4,432,456, a jewelry display and storage apparatus which is provided with an open grid frame and a plurality of domed jewelry display pads is provided. The walls of the frame and the display pads cooperate to form a mechanism wherein the pads are removably retained within the frame. Mounting means are located on the display pads for securing jewelry items thereto. The mounting means are offset so that a 180 degree rotation of the pad or frame clearance is established between jewelry items and adjacent frame levels when stacked.

However, this reference does not teach or suggest a jewelry display and storage apparatus having top and bottom frame members defining an open gridwork, the bottom frame member being matingly engageable with the top frame member so that when said top frame member and said bottom frame member are matingly engaged, the top and bottom frame members form a slotted channel about the interior perimeter of the openings of the inter-engaged frames for receiving and securing one or more jewelry mounting pads within the slotted channel. As well, this reference does not teach or suggest a jewelry display and storage apparatus having spacing means and groove means positioned on either the top or the bottom frame members for spacing the top and bottom frame members and for facilitating mating engagement.

OBJECTS AND SUMMARY OF THE INVENTION

It is therefore an object of the invention to provide a jewelry display and storage apparatus which makes efficient use of available space and that is provided with top and bottom frame members that are matingly engaged.

Another object of the invention is to provide a slotted channel formed by the engagement of the top and bottom frame members, the slotted channel defining a spaced gap between the top and bottom frame members for receiving and securing one or more jewelry mounting pads.

It is an additional object of the invention to provide a jewelry display apparatus in which individual jewelry mounting pads may be easily inserted into the slotted channel between the top and bottom frame members.

A further object of the present invention is to provide a jewelry display and storage apparatus having spacing means and groove means positioned on either the top or the bottom frame members for spacing the top and bottom frame members and for facilitating mating engagement.

It is a further object of the present invention is to provide a stackable display apparatus in which the individual pads are effectively retained within the framework but may be easily removed from the frame.

The foregoing features and advantages are generally accomplished by providing a jewelry display and storage apparatus having a top frame member defining an open gridwork, the gridwork being formed of a series of openings which may be configured in a variety of shapes. As well, a bottom frame member matingly engageable with the top frame member is provided so that when the top frame member and the bottom frame member are matingly engaged, the top and bottom frame members form a peripheral channel about the outer perimeter of the frames.

Additionally, one or more jewelry mounting pads may be provided for mounting within the openings. The jewelry mounting pads are provided with a top surface upon which jewelry may be mounted and displayed, a bottom surface and peripheral side walls adapted to be secured within the openings. The jewelry mounting pads are also provided with a lip about a portion or all of the peripheral side wall perimeters.

The present invention is also provided with mutually engaged bottom and top frame members having walls dimensioned and arranged to permit identical frame members to be stacked on atop the other, such that jewelry mounted on a mounting pad of a first display apparatus sits within an open bottom chamber of the next stacked apparatus and is completely surrounded by and separated from adjacent jewelry items by walls of the next stacked apparatus.

The top frame member of the jewelry display and storage apparatus is provided with upper and lower surfaces as well as a grooved channel located about the periphery of the lower surface. The bottom frame member also includes a lip portion on the upper surface of the bottom frame member. In this way, when the lower surface of the top frame member and the upper surface of the bottom frame member are matingly engaged, the lip portion is received within the channel and thus form an inter-locking fit. The bottom frame member is also provided with a plurality of spacing means positioned on its upper surface positioned to be received within the groove means such that the top frame member is spaced from the bottom frame member to facilitate the mating engagement.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

The preferred embodiment of the invention will be explained in further detail and in reference to the drawing which.

DETAILED DESCRIPTION OF THE PRESENTLY PREFERRED EMBODIMENTS

Figure 1:
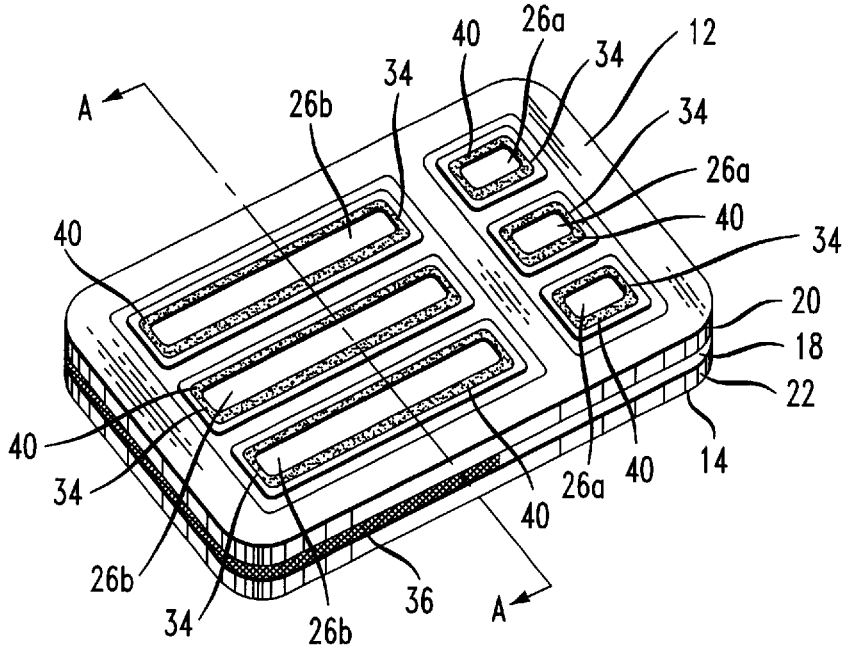
FIG. 1 illustrates a perspective view of the presently preferred embodiment of the display apparatus.
Figure 2:
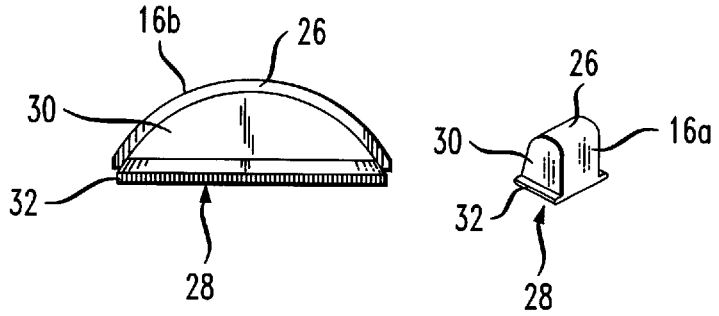
FIG. 2 illustrates a perspective view of the presently preferred embodiment of the display apparatus illustrating the jewelry display pads.

With initial reference to FIG. 1, the jewelry display and storage tray 10 of the present invention is shown in its preferred embodiment. As illustrated, the display tray 10 is comprised of a top frame member 12 and a bottom frame member 14 both of which are preferably fabricated of a plastic material. The top frame member 12 is provided with an open gridwork of openings 26*a*, 26*b* of various dimensions. Openings 26*a*, 26*b* are advantageously configured to accommodate one or more pads 16*a*, 16*b*, as shown in FIG. 2, which correspond in dimension to openings 26*a*, 26*b*. For example, depending on the type of jewelry to be displayed, the openings 26*a*, 26*b* may be either of rectangular shape 26*b* to accommodate rectangular pads 16*b* for holding and displaying bracelets or pendants, or generally square in shape 26*a* to accommodate square pads 16*a* for holding and displaying earrings or rings. As further shown in FIG. 1 and as will be described herein, the bottom frame member 14 is matingly engageable with the top frame member 12 so that when the top frame member 12 and the bottom frame member 14 are matingly engaged, the top and bottom frame members 12, 14 form a peripheral channel 18 about the perimeters 20, 22 of the top and bottom frame members 12, 14, respectively. Advantageously, the frame members 12, 14 may be wrapped with any suitable fabrics such as leather, silk, taffeta, moreu, ultra-suede or even wall paper patterns.

As discussed previously and with continued reference to FIG. 2, the jewelry display and storage apparatus 10 is also provided with one or more mounting pads 16*a* and 16*b* for insertion within receiving spaces 26*a*, 26*b* located within top frame member 12. The jewelry mounting pads 16*a* and 16*b* are advantageously provided with a top surface 26 upon which jewelry (not shown) may be mounted and displayed. The pad 16 is also provided with a bottom surface 28 and peripheral side walls 30 that are adapted to be secured by friction fit or by other suitable inter-engagement means into corresponding openings 26*a* or 26*b*. Peripheral side walls 30 are provided with a lipped engagement means 32 which is received into a corresponding slotted channel 34 or undercut formed in openings 26*a* and 26*b* as a result of the engagement of top and bottom frame members 12, 14. A resting surface 40 extends from upper surface 56 of bottom frame member 14 within openings 26*a* and 26*b*, to provide a platform upon which jewelry display pad 16*a*, 16*b* are supported, and which also serves as a means to prevent pads 16*a*, 16*b* from being inserted through openings 26*a*, 26*b* when positioned therein. The undercut 34 is created by the two piece engagement of the top and bottom frame members 12, 14 so that the undercut 34 is formed about the perimeter of each opening 26*a*, 26*b*.

Figure 3:
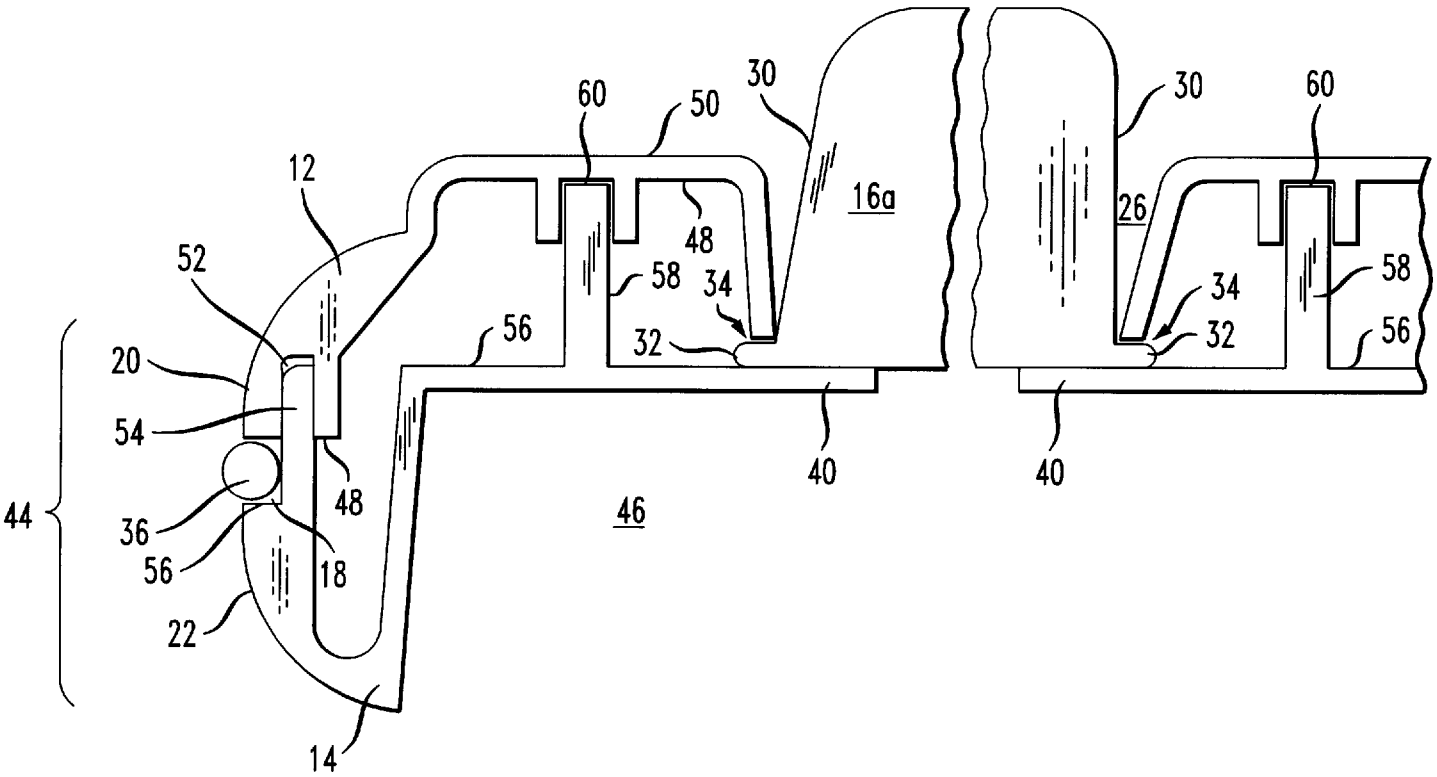
FIG. 3 is a partial exploded elevational cross section taken along lines A—A of FIG. 1 detailing the inter-engagement of the top and bottom frame members along with the spacing means and with the lipped engagement means of the jewelry display pad matingly engaged within the slotted channel of the apparatus of FIG. 1.

As shown in FIGS. 1 and 3, an ornamental band 36 may optionally be provided to add a decorative effect to display apparatus 10 as well as to conceal the inter-engagement of the top and bottom frame members 12, 14. As shown in FIG. 1, ornamental band 36 is shown partially within peripheral channel 18 so as to observe peripheral channel 18. It should be noted that ornamental band 36 extends about the entire perimeter 20, 22 of the top and bottom frame members 12, 14 and may be fabricated from various materials and in different colors and/or patterns, and may be easily removed from peripheral channel 18 and replaced so that ornamental band 36 may be made, for example, to match other display apparatuses 10, or to blend with the surrounding decorum of a store window or display showcase (not shown). It is to be noted that although FIG. 3 shows the peripheral channel 18 as being formed as part of bottom frame member 14, the invention is not limited in this respect and it is understood that the peripheral channel 18 may be incorporated into the top frame member 12.

As shown in FIG. 3, the jewelry display and storage apparatus 10 may be arranged so that one or more displays 10 may be stacked upon one another. For example, top and bottom frame members 12, 14 form a peripheral wall 44, the peripheral wall 44 being dimensioned and arranged to permit identical frame members to be stacked atop the other, such that the jewelry (not shown) mounted on the mounting pad 16 of a first display apparatus 10 sits within the open bottom chamber 46 of the next stacked apparatus 10. In this way, the jewelry is completely surrounded by and separated from adjacent jewelry items by the walls of the next stacked apparatus.

Figure 4:
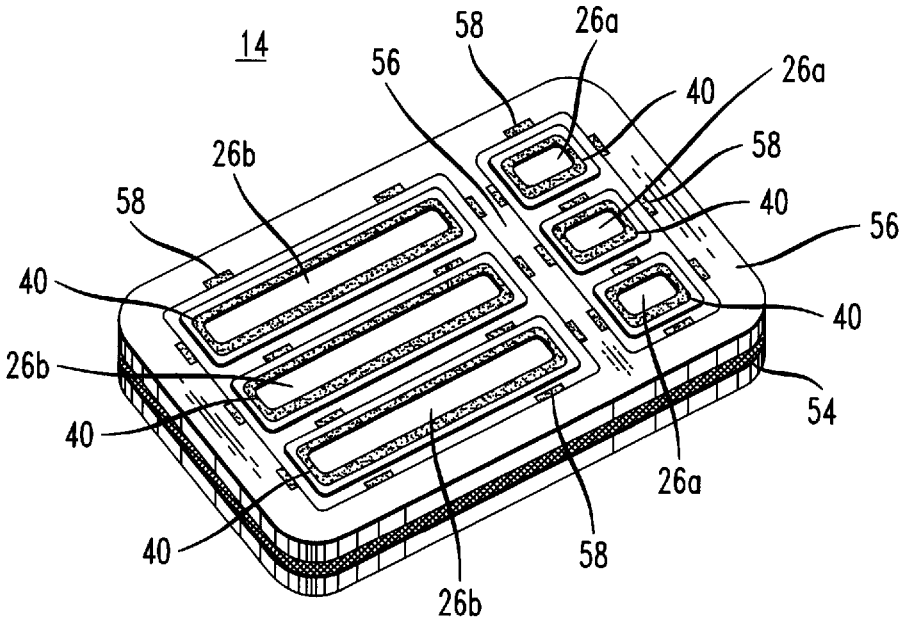
FIG. 4 illustrates is a perspective view of the upper surface of the bottom frame member showing a plurality of spacing means disposed thereon.
Figure 5:
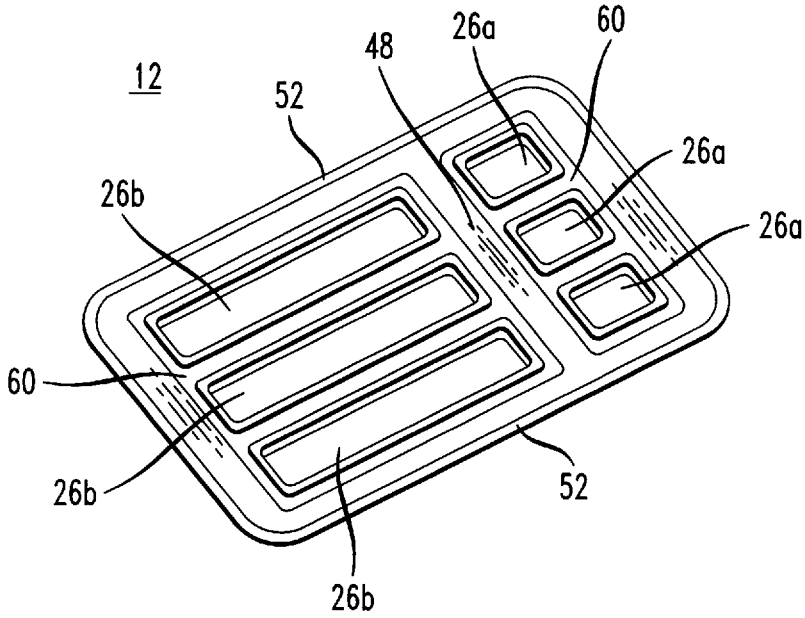
FIG. 5 illustrates a perspective view of the lower surface of the top frame member showing the groove means for receiving the spacing means as illustrated in FIG. 4.

With further reference to FIG. 3, the top frame member 12 is provided with upper and lower surfaces 50, 48. The lower surface 48 of the top frame member 12, shown in FIG. 5, is provided with a peripheral grooved channel 52 located about the periphery of the lower surface 48. As shown in FIGS. 3 and 4, the bottom frame member 14 has a lip portion 54 on a upper surface 56 of the bottom frame member 14. As such, when the lower surface 48 of the top frame member 12 and the upper surface 56 of the bottom frame member 14 are matingly engaged, the lip portion 54 is received within channel 52, as shown in FIG. 3. It should be understood that although grooved channel 52 is shown formed within top frame member 12 and lip portion 54 is shown formed from bottom frame member 14, the invention is not limited in this respect. For example, channel 52 may be formed within bottom frame member 14 while lip portion 54 may be formed from top frame member 12.

Similar to this lip/channel arrangement described above and as also shown in FIG. 3, upper surface 56 of bottom frame member 14 is additionally provided with spacing means 58 disposed about upper surface 56. Spacing means 58 may be arranged in a linear fashion or may be randomly dispersed on upper surface 56 as shown in FIG. 4. Similar to grooved channel 52, top frame member 12 is provided with a grooved channel 60 on its lower surface 48, as illustrated in FIG. 5, so that when the spacing means 58 is matingly engaged within grooved channel 60, slotted channel 34 is defined in openings 26*a*, 26*b* from bottom frame member 14 to facilitate the mating engagement between the top and bottom frame members 12, 14. The invention is not, however, limited in this respect, and spacing means 58 may alternatively be positioned on the lower surface 48 of top frame member 12 with the grooved channel 60 being positioned on the upper surface 56 of the bottom frame member 14. Accordingly, when slotted channel 34 is provided, the pad 16 is thus adapted to be secured by corresponding openings 26*a* or 26*b*. Peripheral side walls 30 are provided with a lipped engagement means 32 which is received into a corresponding slotted channel 34 formed in openings 26*a* and 26*b* as a result of the engagement of top and bottom frame members 12, 14. This lipped engagement means 32 may be provided about the four sides of the peripheral side walls, about two opposite side walls or even about the four comers all without departing from the spirit of the invention. As shown in FIGS. 3 and 4, resting surface 40 extends from upper surface 56 of bottom frame member 14 within openings 26*a* and 26*b*, to provide a platform upon which jewelry display pad 16*a*, 16*b* are supported, and which also serves as a means to prevent pads 16*a*, 16*b* from being inserted through openings 26*a*, 26*b* when positioned therein.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirt of the invention. It is the intention, therefore, to be limited only as indicated by the scope of the claims appended hereto.

It is to be understood that the drawings are not necessarily drawn to scale, but that they are merely conceptual in nature.

What is claimed is:

1. A jewelry display and storage apparatus for receiving a jewelry display pad, the jewelry display pad having an upper surface, a lower surface, and peripheral side walls, said peripheral side walls containing lipped engagement means at one or more ends thereof, horizontally placed and adjacent with said lower surface, said apparatus comprising:

a top frame member defining an open gridwork, said gridwork being formed of a series of openings; and a bottom frame member matingly engageable with said top frame member, said bottom and top frame members having perimeters so that when said top frame member and said bottom frame member are matingly engaged, said top and bottom frame members form a peripheral channel about said perimeters of said bottom and top frame members, said bottom frame member is provided with upper and lower surfaces, said upper surface of said bottom frame member having spacing means disposed thereon so that when said top frame member and said bottom frame member are matingly engaged, said spacing means space said top frame member from said bottom frame member so as to receive said lipped engagement means of said jewelry display pad.

2. The jewelry display and storage apparatus of claim 1, wherein said mutually engaged bottom and top frame members are provided with walls, said walls being dimensioned and arranged to permit identical frame members to be stacked on atop the other, such that jewelry mounted on said mounting pad of a first display apparatus sits within an open bottom chamber of the next apparatus and is completely surrounded by and separated from adjacent jewelry items by walls of the next stacked apparatus.

3. The jewelry display and storage apparatus of claim 1, wherein said top frame member is provided with upper and lower surfaces, said top frame member further comprises a grooved channel located about the periphery of the lower surface, said bottom frame member further comprises a lip portion on said upper surface of said bottom frame member, so that when said lower surface of said top frame member and said upper surface of said bottom frame member are matingly engaged, said lip portion is received within said channel.

4. The jewelry display and storage apparatus of claim 3, wherein said top frame member is provided with upper and lower surfaces, said top frame member further comprises a second grooved channel located on the lower surface about the periphery of said openings, said bottom frame member further comprises a second lip portion on said upper surface of said bottom frame member, so that when said lower surface of said top frame member and said upper surface of said bottom frame member are matingly engaged, said second lip portion is received within said second channel.

5. The jewelry display and storage apparatus of claim 1, wherein said openings of said top frame member define a perimeter wall configured to receive a jewelry mounting pad for mounting within said perimeter wall, said jewelry mounting pad having a top surface upon which jewelry may be mounted and displayed, a bottom surface and peripheral side walls, said bottom surface and a portion of said peripheral side walls securable within said perimeter wall.

6. The jewelry display and storage apparatus of claim 5, wherein said peripheral side walls of said jewelry mounting pad contain lipped engagement means at one or more ends thereof, horizontally placed and adjacent with said lower surface of the jewelry mounting pad.

7. The jewelry display and storage apparatus of claim 6, wherein said lower frame member further comprises a resting surface, said resting surface extending within said openings of said top frame member so that said lipped engagement means rests thereon.

8. The jewelry display and storage apparatus of claim 5, wherein said pad is selectively insertable and removable from said opening within said top frame member.

9. The jewelry display and storage apparatus of claim 1, wherein said top and bottom frame members are made of a plastic material.

10. The jewelry display and storage apparatus of claim 1, wherein said bottom frame member further comprises downwardly projecting side walls for elevating said upper surface of said bottom frame member.

* * * * *